US010786790B2

(12) United States Patent
Hiemer et al.

(10) Patent No.: US 10,786,790 B2
(45) Date of Patent: Sep. 29, 2020

(54) MULTICOMPONENT STATIC MIXER FOR MIXING COMPONENTS

(71) Applicant: Sulzer Mixpac AG, Haag (CH)

(72) Inventors: Andreas Hiemer, Rebstein (CH); Joachim Schöck, Winterthur (CH); Percy Leue, Singen (DE)

(73) Assignee: SULZER MIXPAC AG, Haag (CH)

( * ) Notice: Subject to any disclaimer, the term of this patent is extended or adjusted under 35 U.S.C. 154(b) by 253 days.

(21) Appl. No.: 15/337,108

(22) Filed: Oct. 28, 2016

(65) Prior Publication Data

US 2017/0120206 A1 May 4, 2017

(30) Foreign Application Priority Data

Oct. 30, 2015 (EP) ..... 15192415

(51) Int. Cl.
*B01F 5/06* (2006.01)
*B05C 17/005* (2006.01)

(52) U.S. Cl.
CPC ..... *B01F 5/0658* (2013.01); *B01F 5/061* (2013.01); *B01F 5/0612* (2013.01); *B01F 5/0641* (2013.01); *B01F 2215/006* (2013.01); *B01F 2215/0027* (2013.01); *B01F 2215/0039* (2013.01); *B01F 2215/0047* (2013.01); *B05C 17/00553* (2013.01)

(58) Field of Classification Search
CPC ..... B01F 5/0658; B01F 5/061; B01F 5/0612; B01F 5/0641; B01F 2215/0039
USPC ..... 366/337
See application file for complete search history.

(56) References Cited

U.S. PATENT DOCUMENTS 4,771,919 A 9/1988 Ernst
4,995,540 A 2/1991 Colin et al.
(Continued)

FOREIGN PATENT DOCUMENTS

EP 0584428 A1 3/1994
EP 0600138 A1 6/1994
(Continued)

OTHER PUBLICATIONS

Extended European Search Report dated May 2, 2016 in corresponding EP Patent Application No. 15192415.6.

*Primary Examiner* — Marc C Howell
(74) *Attorney, Agent, or Firm* — Gobal IP Counselors, LLP

(57) ABSTRACT

The present invention relates to a static mixer for mixing together at least two components. The static mixer comprises a mixer housing;

Figure 1B:
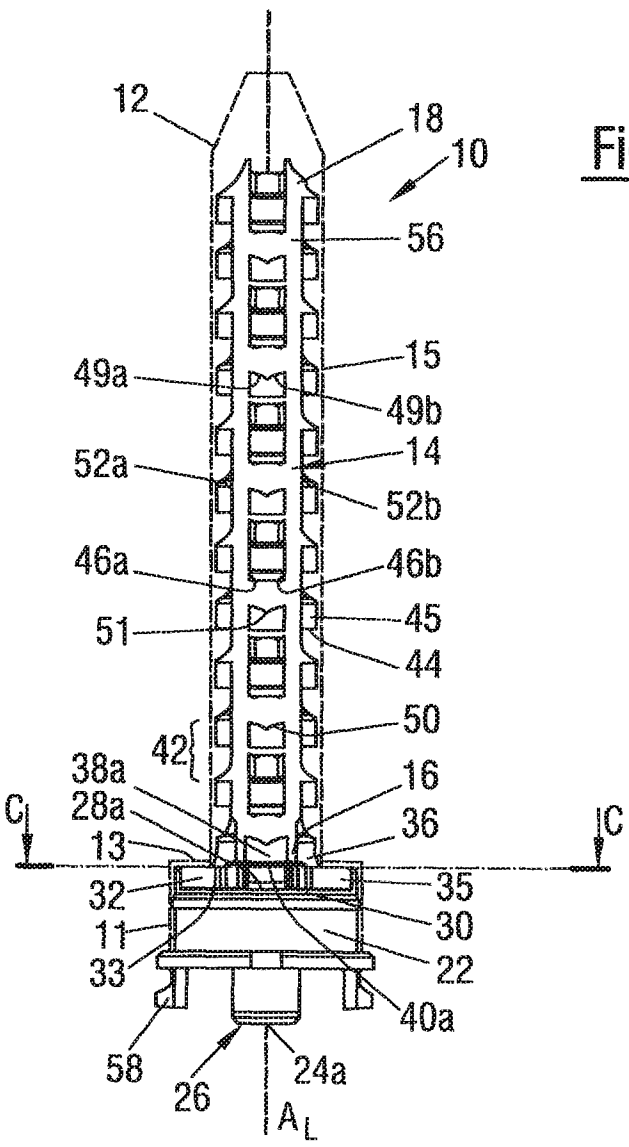

a mixing element having an upstream end with at least two entry openings and a downstream end, the mixing element being arranged at least partly within the mixer housing;

a mixing head having at least two inlets provided at an input side and at least two outlets provided at an output surface, wherein each of the at least two inlets is in fluid communication with one of the at least two outlets; and a separating wall disposed between the output surface and the upstream end of the mixing element for separating the components leaving the outlets.

The separating wall comprises a free downstream edge which is disposed with respect to at least one of the entry openings so as to allow at least partial flows of the components separated by the separating wall to combine after (Continued)

exceeding the downstream edge and to jointly enter said at least one of the entry openings.

23 Claims, 7 Drawing Sheets

(56) References Cited

U.S. PATENT DOCUMENTS

| | | | | |
|---|---|---|---|---|
| 5,458,262 | A | 10/1995 | Keller | |
| 5,487,606 | A | 1/1996 | Keller | |
| 5,498,078 | A | 3/1996 | Keller | |
| 6,135,631 | A * | 10/2000 | Keller | B01F 5/0615 222/145.6 |
| 2004/0141413 | A1* | 7/2004 | Keller | B01F 5/0617 366/337 |
| 2008/0232191 | A1 | 9/2008 | Keller | |
| 2013/0135963 | A1 | 5/2013 | Linne et al. | |
| 2014/0110435 | A1* | 4/2014 | Pappalardo | B01F 5/0082 222/145.5 |

FOREIGN PATENT DOCUMENTS

| | | | |
|---|---|---|---|
| EP | 0723807 | A2 | 7/1996 |
| EP | 1426099 | A1 | 6/2004 |
| EP | 2527029 | A2 | 11/2012 |
| EP | 2724788 | A1 | 4/2014 |
| WO | 2012116873 | A1 | 9/2012 |

* cited by examiner

MULTICOMPONENT STATIC MIXER FOR MIXING COMPONENTS

The present invention relates to a static mixer for mixing together at least two components comprising: a mixer housing; a mixing element having an upstream end with at least two entry openings; a mixing head having at least two inlets provided at an input side and at least two outlets provided at an output surface; and a separating wall disposed between the output surface and the upstream end for separating the components leaving the outlets. The invention further relates to a dispensing apparatus.

A wide variety of ways of dispensing two-component masses from cartridges is known in the prior art. The materials to be dispensed are typically a matrix material and a hardener. Two-component materials are typically used as impression materials, e.g. on the formation of dental impressions, as a cement material for prosthetic restorations, as a temporary cement for trial cementing restorations or for cementing temporary crowns. Further applications of two-component materials are in the building industry where they are e.g. used as a replacement for mechanical joints that corrode over time. Adhesive bonding can be used to bond products such as windows and concrete elements. The use of multi-component protective coatings, for example moisture barriers, corrosion protection and anti-slip coatings, is also becoming increasingly common.

The filled cartridges come in different ratios referred to as 1:1, 2:1, 4:1 and 10:1 etc., the numbers specifying the ratios of the amounts of each of the two materials that are to be dispensed. The reason for these different ratios is to allow a wide variety of different compositions to be mixed and dispensed. For example some compositions require more hardener and some require less hardener. Also some compositions require more mixing.

Static mixers, also referred to as mixing tips, are generally known from the prior art. The static mixers are adapted to mix the compositions as they exit the cartridge. In this respect different length and different diameter mixing tips are provided to ensure a thorough through mixing of the various two-component mixtures. The mixing tips typically have an insert resembling e.g. an open spiral which forces the two-components into contact with one another and exerts forces on them causing them to mix.

The individual components of the multi-components to be mixed are frequently fairly expensive so there is a need to reduce the volume of material lost after a mixing process has taken place. To reduce the volume remaining in a static mixer specific designs have been implemented resulting in a reduced length of the static mixer. However, the reduction in length has led to very complicated designs since a reduction in length normally adversely affects the through mixing of the multi-components. Generally speaking, a shorter length of the static mixer has to be balanced by a more improved design in order to prevent a deterioration of the through mixing of the multi-components. Since the static mixers are frequently manufactured by injection molding, their production has become very demanding in effort and cost, as highly complex molds are necessary.

Therefore, it is an object of the present invention to provide a static mixer in which the through mixing of the multi-components is improved, on the one hand, without excessively increasing the residue of the multi-component material being left after use, i.e. without excessively increasing the length of the static mixer, and, on the other hand, without excessively complicating the design of the static mixer.

This object is satisfied by a static mixer having the features of claim 1.

In particular such a static mixer is suitable for mixing together at least two components and comprises: a mixer housing; a mixing element having an upstream end with at least two entry openings and a downstream end, the mixing element being arranged at least partly within the mixer housing; a mixing head having at least two inlets provided at an input side and at least two outlets provided at an output surface, wherein each of the at least two inlets is in fluid communication with one of the at least two outlets; and a separating wall disposed between the output surface and the upstream end of the mixing element for separating the components leaving the outlets.

The static mixer is characterized in that the separating wall comprises a free downstream edge which is disposed with respect to at least one of the entry openings of the mixing element so as to allow at least partial flows of the components separated by the separating wall to combine after exceeding the downstream edge and to jointly enter said at least one of the entry openings.

Providing such a separating wall, on the one hand, ensures that the mixing element being arranged at least partly within the mixer housing is uniformly supplied with the components. On the other hand, the separating wall positions the components relative to each other such that at least one of the entry openings of the actual mixing element already is supplied with a mixed flow consisting of at least two components. In other words, a streak consisting of at least two partial flows of the components is fed into at least one entry opening. This ensures an optimum mixing result and hence permits a reduction in the length of the mixing element. A reduction in length of the static mixer leads to a reduction in any residual volume that is left in the static mixer after its use.

In this connection it should be noted that the feature according to which the mixing element is at least partly provided within the housing means that at least mixer elements of the mixing element are arranged within the mixer housing and that, for example, components of the separating wall or the mixing head may project out of the mixer housing. However, it is preferred if at least the mixing element and the separating wall are arranged within the mixer housing.

Preferably the separating wall can have a meandering pattern. By "meandering" it is meant that the separating wall comprises a winding and a turning course. For example, the separating wall may comprise zigzag, sinusoidal, undulating or step-like patterns. The separating wall may also comprise combinations of the aforementioned patterns, i.e. different wall segments with different patterns.

Advantageously the pattern of the separating wall may be designed such that each entry opening of the mixing element is fed with at least two partial flows of the components, i.e. each entry opening is supplied by a streak consisting of at least one partial flow of each component.

The separating wall may comprise at least two linear segments. Optionally, the separating wall may comprise at least two segments being parallel to each other. In general, a segment is a part or a section of the separating wall being separated from another part or section of the separating wall by a winding or turning. For example, two segments being parallel to each other may be interconnected by at least one other segment, wherein the other segment can either be curved or linear.

In a preferred embodiment, the separating wall comprises a curved segment, a linear segment, a linear or curved segment, a linear segment and a curved segment in the sequence stated. In this embodiment, it is particularly preferred if the two linear segments flanking the one linear or curved segment are parallel to each other.

It is preferred if the separating wall comprises thickened segments for reducing a volume accessible for the components when leaving the outlets of the mixing head. The thickened segments preferably may have a greater wall thickness than other segments of the separating wall. By varying the thickness of the separating wall or its segments, the volume occupied by the components after leaving the outlets can be adjusted. Advantageously narrowing this volume leads to a reduction in the residual volume of components left behind in the static mixer after its use. The accessible volume is thereby defined as the free space between the outlets of the mixing head and the entry openings of the mixing element. In particular, the thickened segments may be provided for reducing the free space between the outlets of the mixing head and the entry openings of the mixing element.

Having regard to a mixing ratio of 1:1, it is particularly preferred if the volume accessible for each component after leaving the outlet essentially is the same. Maintaining the same volume for both components particularly prevents an undue forerunning of either of the components.

However, having regard to higher mixing ratios like 2:1, 4:1 or 10:1 etc., it can be preferable to reduce the volume for one component in favour of another component to be added in higher volumes.

In some embodiments it can be of advantage if the separating wall partially frames or surrounds at least one outlet at the outlet surface and/or at least one entry opening at the upstream end of the mixing element. Such a design leads to an improved flow path of the components between the output surface of the mixing head and/or the upstream end of the mixing element and the components can enter the entry openings at an optimum spot.

In this connection it can be preferred that the separating wall at least partially cooperates with the mixer housing, preferably with an inner surface of the mixer housing, to provide a component flow guide region at the entry openings of the mixing element. In other words, the separating wall can be at least partially aligned flush with a wall of the mixer housing. In this context it can be further preferred that the separating wall and the wall of the mixer housing essentially have the same thickness, at least at points where the separating wall and the wall of the mixer housing cooperate or are aligned flush.

In a preferred embodiment the separating wall can be integrally formed with the mixing element or with the mixing head. In this context, the mixing head and the mixing element can be held together in an axial direction by means of a plug connection preferably formed by the separating wall cooperating with the mixing element or with the mixing head. The plug connection can also be formed by other plug and counter plug elements being assigned to the mixing element or the mixing head.

Optionally, the separating wall can be integrally formed with the mixing element and with the mixing head, thereby forming a one-piece construction. Advantageously the separating wall, the mixing head and the mixing element can be a one-piece construction formed by injection molding. It is further preferred if the mixer housing and the aforementioned one-piece construction are formed as separate elements. It is also conceivable if the mixer housing, the mixing head, the mixing element and the separating wall are formed as separate elements.

In some embodiments it can be of advantage if the static mixer further comprises an intermediate wall disposed between the upstream end of the mixing element and the separating wall.

Preferably, the intermediate wall can define two sides, wherein each side is assigned to at least one outlet of the mixing head and/or to at least one entry opening of the mixing element. It is particularly preferred if each of the two sides defined by the intermediate wall is respectively assigned to exactly one outlet.

Advantageously the intermediate wall can be disposed such that an entry opening is assigned to each side defined by the intermediate wall. It is particularly preferred if the intermediate wall separates one entry opening on the one side and two entry openings on the other side. Expediently, the intermediate wall can be disposed to not traverse one of the entry openings of the mixing element. In other words, the intermediate wall can be disposed to run between the entry openings.

The intermediate wall can be disposed to divide the components separated by the separating wall by at least partially traversing the separating wall. Expediently, the intermediate wall can traverse at least one linear segment of the separating wall at an angle of between 70° and 110°, preferably between 80° and 100°, more preferably between 85° and 95°, in particular of approximately 90°.

The intermediate wall can extend essentially linear and/or can have the same height as the separating wall. As regards further patterns or shapes the intermediate wall can have reference is made to the above explanations on the separating wall. The intermediate wall can be at least partially, but preferably fully, arranged within the mixer housing.

The intermediate wall can preferably be integrally formed with the mixing element. The intermediate wall also can be integrally formed with the separating wall, wherein the separating wall preferably can be integrally formed with the mixing head. In either case, a plug connection can be provided to connect the mixing element and the mixing head. Expediently, the mixing element, the intermediate wall, the separating wall and the mixing head can be a one-piece construction, preferably formed by injection molding.

In a preferred embodiment the static mixer further comprises at least one flow obstruction disposed between the upstream end of the mixing element and the output surface of the mixing head for deflecting the components or at least partial flows of the components.

Advantageously the at least one flow obstruction can be disposed between the downstream edge of the separating wall and the upstream end of the mixing element or between the downstream edge of the separating wall and an upstream edge of the intermediate wall. However, it is particularly preferred if the at least one flow obstruction is essentially disposed in one plane with the downstream edge of the separating wall or if it is disposed adjacent to the downstream edge of the separating wall.

Providing such a flow obstruction prevents an undue forerunning of either of the components after leaving the outlets of the mixing head and guarantees a uniform distribution of the partial flows of the components to the entry openings of the mixing element.

The at least one flow obstruction can preferably be planar and can preferably have an even upper and lower surface. For instance, the flow obstruction can have a rectangular, triangular, semi-circular, lenticular or crescent shape. Expediently the thickness of the flow obstruction can be equal to or smaller than the thickness of the separation wall and/or the intermediate wall.

It is preferred if at least one, in particular exactly one, flow obstruction is assigned to an opening cross-section defined by one of the at least two outlets. In other words, the flow obstruction can preferably partly overlap with the opening cross-section of one outlet. This particularly ensures that the components when leaving the outlets at first fully occupy a volume located below the respective flow obstruction before proceeding further towards the mixing element. In this context, the flow obstruction acts as a kind of deflector or intermediate stopper.

The static mixer can preferably have a longitudinal axis and at least two flow paths extending between the at least two inlets and outlets, wherein each inlet and outlet has a geometric center. The geometric center of each of the at least two outlets and inlets can preferably be equally spaced apart from the longitudinal axis. However, it can be preferred that the geometric center of at least one, preferably of each, of the at least two outlets being spaced less far apart from the longitudinal axis than the geometric center of at least one, preferably of each, of the at least two inlets.

The mixing element can advantageously comprise a plurality of mixer elements arranged one after another for a repeated separation and re-combination of streams of the components to be mixed.

For an as good as possible mixing result the mixing element can comprise mixer elements for separating the material to be mixed into a plurality of streams, as well as means for the layered merging of the same. Those elements and means include a transverse edge and guide walls that extend at an angle to said transverse edge, as well as guide elements arranged at an angle to the longitudinal axis and provided with openings. The mixing element comprises a transverse edge and a following transverse guide wall and at least two guide walls ending in a separating edge each with lateral end sections and with at least one bottom section disposed between said guide walls. Thereby at least one opening on one side of said transverse edge and at least two openings on the other side of said transverse edge is defined.

Alternatively, the mixing element can comprise mixer elements for separating the material to be mixed into a plurality of streams, as well as means for the layered merging of the same, including separating edges and a transverse edge that extends at an angle to said separating edges, as well as deflecting elements arranged at an angle to the longitudinal axis and provided with openings. The mixing element comprises at least two separating edges with following guide walls with lateral end sections and with at least one bottom section disposed between said guide walls, and a transverse edge arranged at one end of a transverse guide wall. Thereby at least one opening on one side of said transverse edge and at least two openings on the other side of said transverse edge is defined.

In a preferred embodiment, the mixing element can have three entry openings, one being arranged on one side of said traverse edge and two being arranged on the other side of said traverse edge.

Details regarding the design of such a mixing element are described in European Patent EP-B-1 426 099, which is incorporated by reference to the extent that it discloses such a mixing element.

Advantageously the intermediate wall can correspond to a first transverse guide wall of the upstream end of the mixing element.

Since according to the present invention at least partial flows of the components already jointly enter at least one of the entry openings of the mixing element, the separation and re-combination process can result in a higher number of streams or streaks after the components having passed through a first mixer element of the mixing element. This significantly improves the mixing result and allows for a reduction in length of the static mixer.

The mixer elements of the mixing element can preferably be held together by struts, wherein the struts can also act as further guide and deflecting walls. Expediently, the struts can make direct contact with the mixer housing when the mixing element is arranged within the housing. The struts thus can act as guide for the mixer housing during assembly.

In a further aspect, the present invention relates to a dispensing apparatus comprising a multi-component cartridge and a static mixer as described in the foregoing that is connected to the multi-component cartridge, with the multi-component cartridge preferably being filled with respective components.

In still a further aspect the present invention relates to a use of a static mixer of the kind described herein or a dispensing apparatus of the kind described herein in order to dispense components from a multi-component cartridge via the static mixer.

Figure 1A:
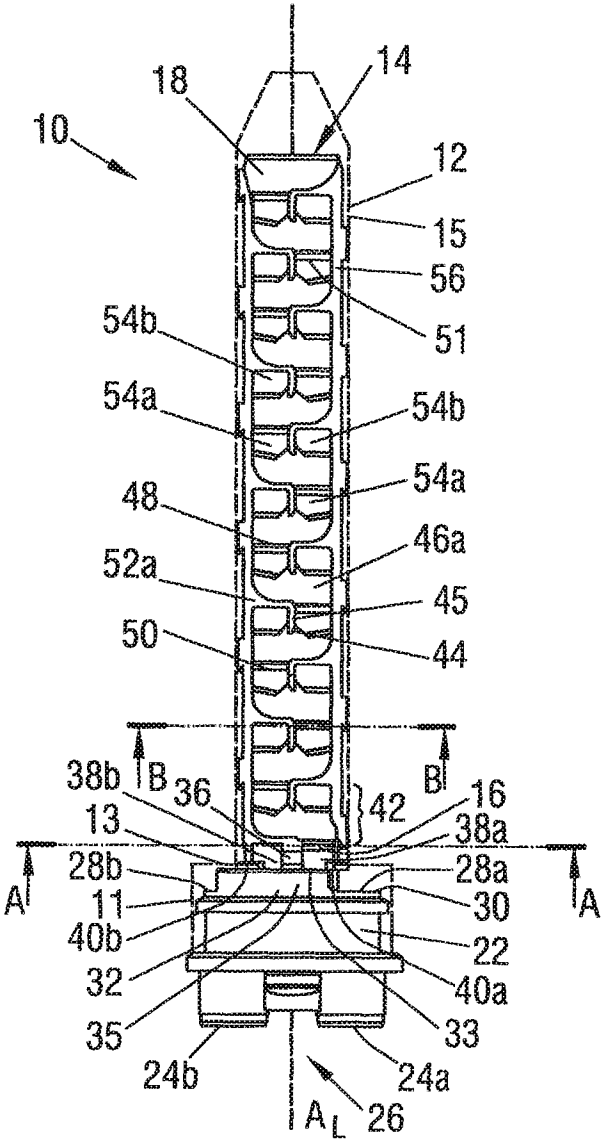
Figure 2:
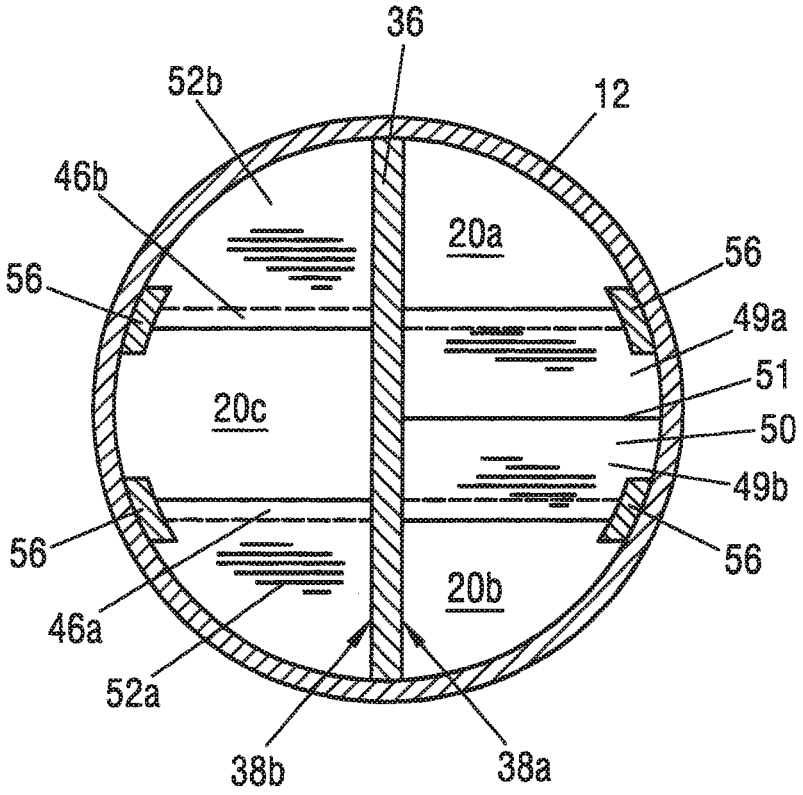

Further embodiments of the invention are described in the following description of the figures. The invention will be explained in the following in detail by means of embodiments and with reference to the drawing in which is shown:

FIG. 1*a* a side view of a static mixer according to the invention;

FIG. 1*b* the static mixer from FIG. 1*a* rotated by 90° to the left;

FIG. 2 a cross-sectional view along the section line A-A of the static mixer of FIG. 1*a,*

Figure 3B:
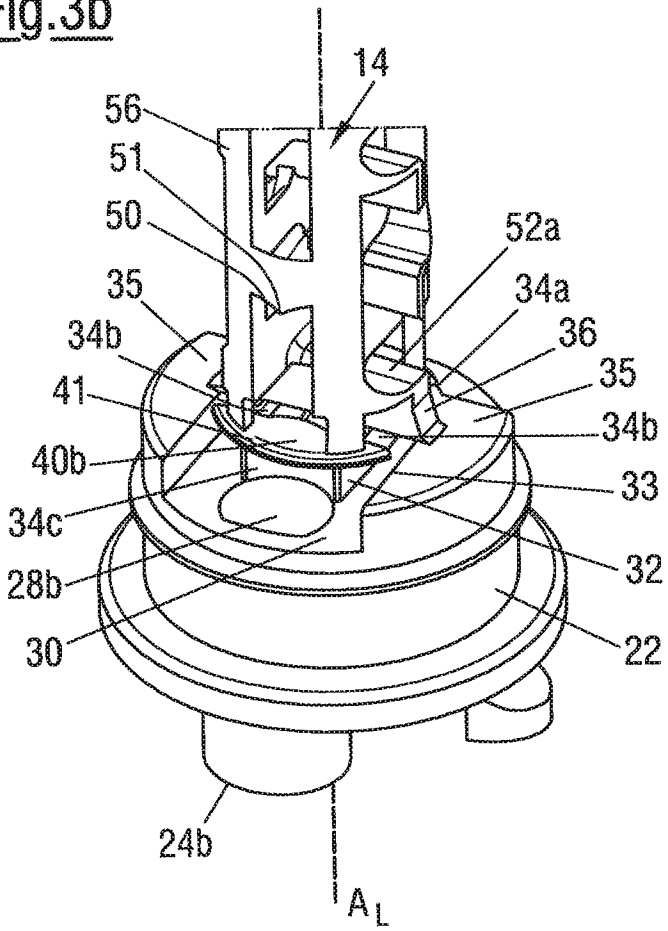
Figure 3A:
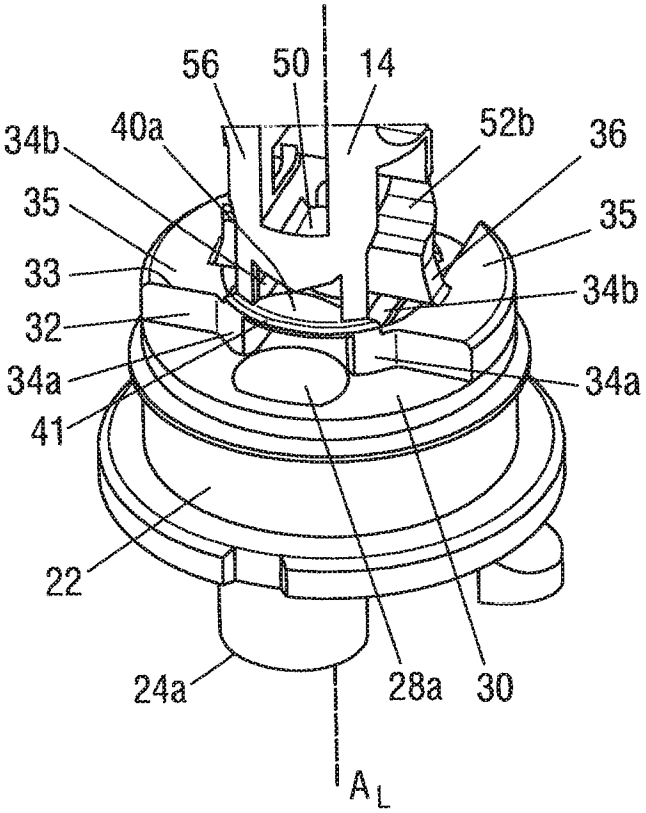

FIG. 3*a* a perspective part view of the static mixer of FIGS. 1*a*, 1*b;*

Figure 4B:
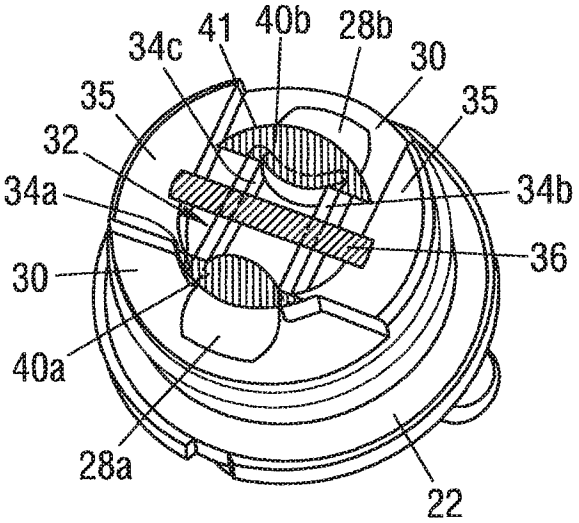
Figure 4C:
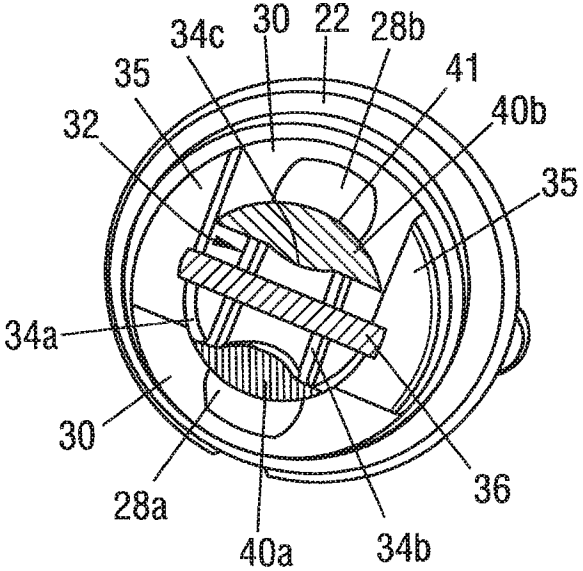
Figure 4A:
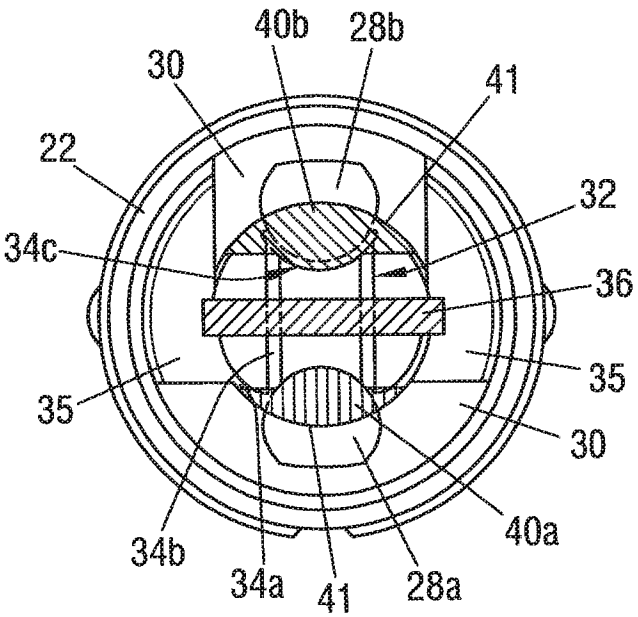

FIG. 3*b* the static mixer from FIG. 3*a* rotated by 180°;

FIGS. 4*a*, 4*b*, 4*c* perspective cross-sectional views along the section line C-C of the static mixer of FIG. 1*b;*

Figure 5B:
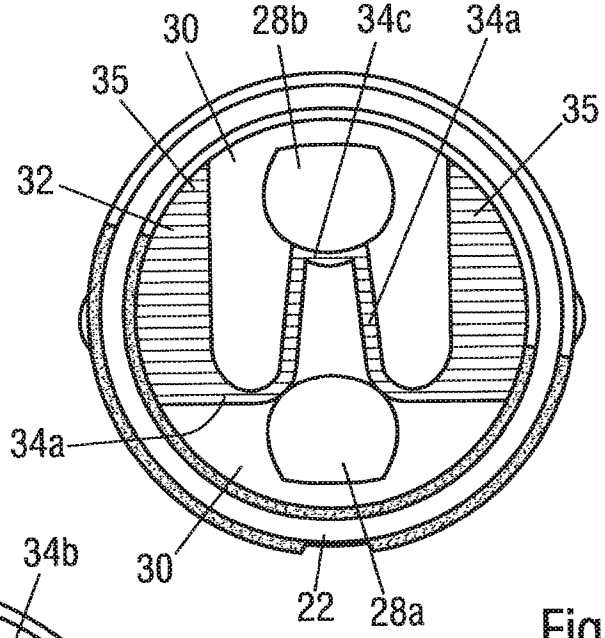
Figure 5A:
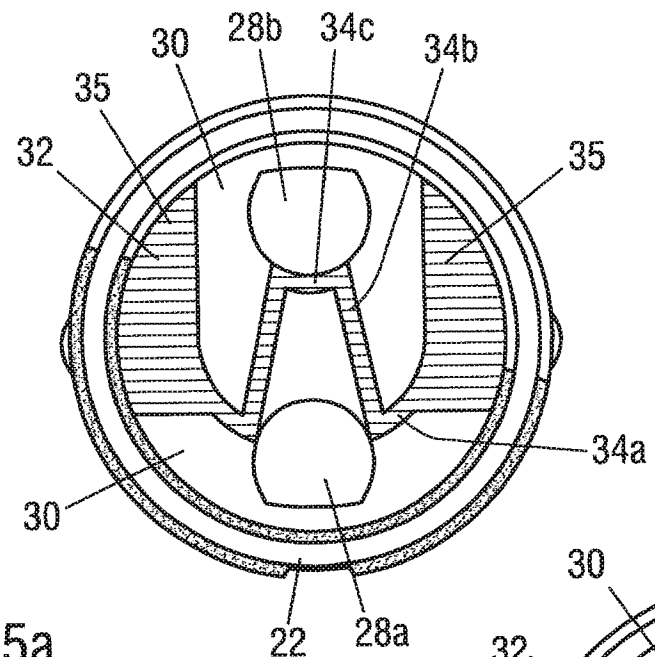
Figure 5C:
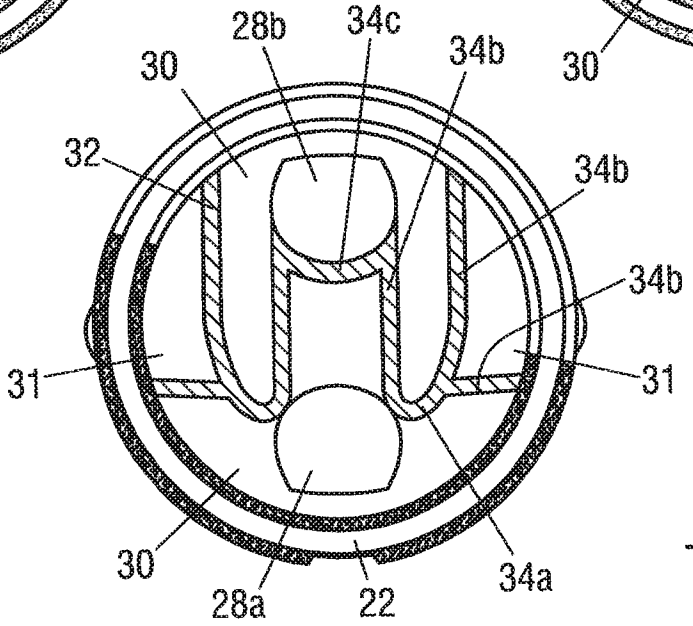
Figure 6:
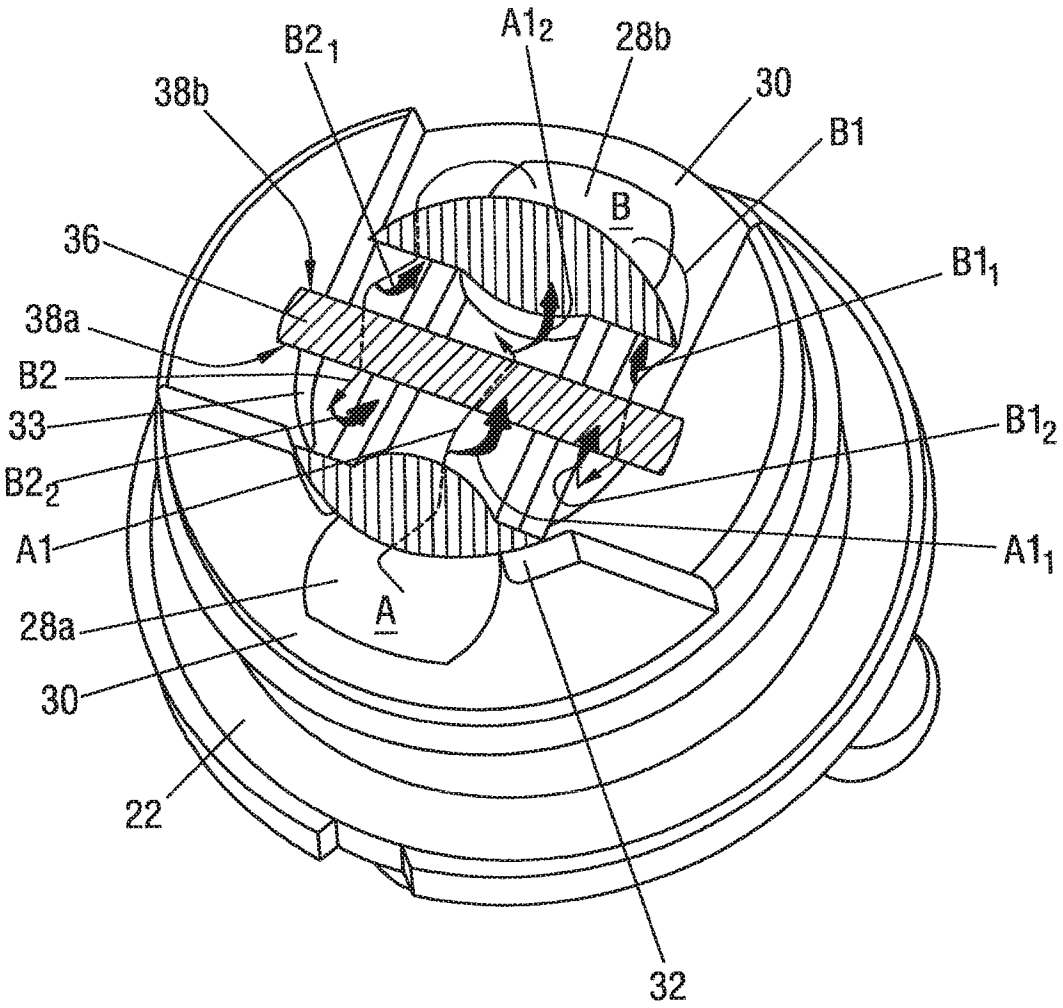
Figure 7:
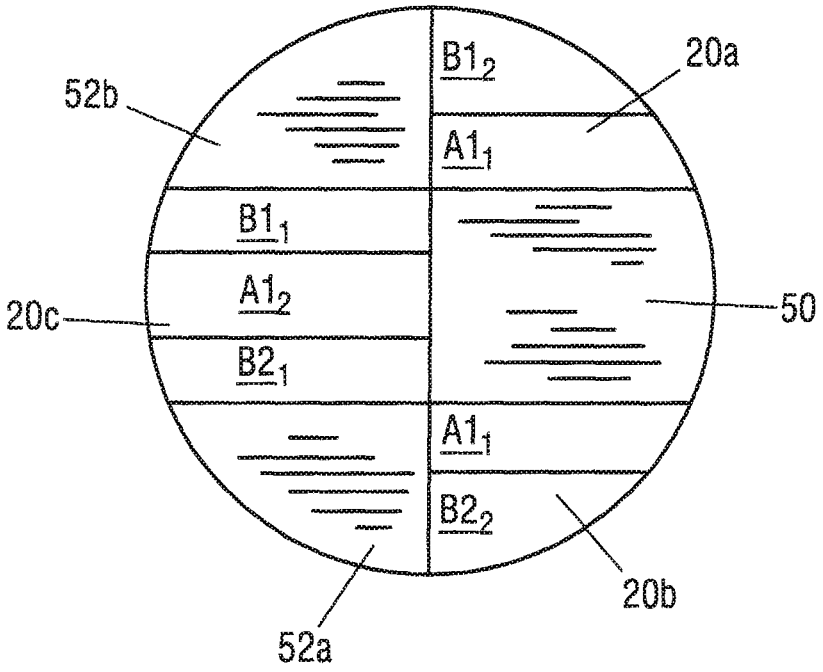

FIGS. 5*a*, 5*b*, 5*c* perspective cross-sectional views of the separating wall of three further embodiments of a static mixer according to the invention;

FIG. 6 an enlarged cross-sectional view of FIG. 4*b* with indicated flow paths; and FIG. 7 a simplified cross-sectional view along the entry plane of the entry openings.

In the following the same reference numerals will be used for parts having the same or equivalent function. Any statements made having regard to the direction of a component are made relative to the position shown in the drawing and can naturally vary in the actual position of application.

FIG. 1*a* shows a side view of a static mixer 10 with a longitudinal axis $A_L$ comprising a mixer housing 12, a mixing element 14, an intermediate wall 36, a separating wall 32 and a mixing head 22. The mixer housing 12 is indicated by a dashed line and comprises a shoulder 13 separating a wider housing section 11 from a tube-like narrow housing section 15. Apart from the mixer housing 12, the static mixer 10 is a one-piece construction fabricated by injection molding. FIG. 1*b* shows the static mixer 10 rotated by 90° to the left about the longitudinal axis $A_L$.

The mixing element 14 and part of the mixing head 22 are arranged within the mixer housing 12. The mixer housing 12, in particular the wider housing section 11, can further comprise a connection element for establishing a connection to a cartridge (not shown). For example, the connection element can be a sleeve in which the narrow housing section 15 can be received. The sleeve can have an internal thread for establishing a screwed joint and/or means for establishing a bayonet coupling to the cartridge. Further, the mixing head and/or the sleeve can be provided with connection means for establishing a plug connection with the cartridge.

The mixing head 22 has two inlets 24*a*, 24*b* provided at an input side 26. Each of the two inlets 24*a*, 24*b* is in fluid communication with a corresponding outlet 28*a*, 28*b* provided at an output surface 30. The inlets 24*a*, 24*b* are of the same size as the outlets 28*a*, 28*b*. The inlets 24*a*, 24*b* are of the same size as the outlets 28*a*, 28*b*. Also, the inlets 24*a*, 24*b* and the outlets 28*a*, 28*b* among each other are of the same size. Further, a flow channel defined by inlet 24*a* and outlet 28*a* has the same volumetric capacity as a corresponding flow channel defined by inlet 24*b* and outlet 28*b*.

The separating wall 32 is arranged between the output surface 30 and the intermediate wall 36. The separating wall 32 partly surrounds the outlet 28*b* and comprises two thickened segments 35 and further segments 34*a*, 34*b*, 34*c* (see FIGS. 3 and 4). Being arranged in one plane with a downstream edge 33 of the separating wall 32, the static mixer further comprises flow obstructions 40*a*, 40*b* which partly overlap with the openings 28*a* or 28*b* (see FIGS. 3 and 4).

The intermediate wall 36 is located at an upstream end 16 of the mixing element 14 and is disposed between the separating wall 32 and a first mixer element 42. The intermediate wall 36 traverses the separating wall 32 and defines two sides 38*a*, 38*b*, wherein the side 38*a* is assigned to the outlet 28*a* of the mixing head 22 and to two entry openings 20*a*, 20*b* of the mixing element 14. The side 38*b* is assigned to outlet 28*b* and one entry opening 20*c*. This becomes more obvious in FIG. 2.

The mixing element 14 comprises several successive mixer elements 42, wherein each mixer element 42 comprises a transverse guide wall 45 with a transverse edge 44, followed by two guide walls 46*a*, 46*b* each extending at a 90° angle to the transverse guide wall 45 and each having a separating edge 48. A bottom section 50 having a bottom edge 51 at its lower side is disposed between the two guide walls 46*a*, 46*b*. The bottom edge 51 divides the lower side of the bottom section 50 into two sloping parts 49*a*, 49*b*. Further, each of the guide walls 46*a*, 46*b* has one lateral end section 52*a*, 52*b*. Thereby three openings for the components to pass through are defined. One opening is defined on a side 54*b* of the transverse edge 44 and two openings are defined on a side 54*a* of the transverse edge 44. The arrangement of the openings corresponds to the arrangement of the entry openings 20*a*, 20*b*, 20*c*, which is why the sides 56*a*, 56*b* and the sides 38*a*, 38*b* defined by the intermediate wall 36 essentially correspond to each other. The arrangement of the openings becomes more obvious from FIG. 2.

The individual successive mixer elements 42 are connected to one another by struts 56, with the struts 56 also acting as further guide walls. The number of mixer elements 42 and the corresponding length of the struts 56 is selected in dependence on the kind of material that is to be dispensed with a certain static mixer 10. For some applications five mixer elements 42 may be sufficient whereas for others ten or more mixer elements 42 may need to be connected to one another by means of struts 56. An outer surface of the struts 56 has the same curvature as an inner surface of the mixer housing 12 and the struts 56 make direct contact to the mixer housing 12.

FIG. 2 shows a cross-sectional view of the static mixer 10 of FIG. 1 (along section line A-A) thereby indicating the arrangement of the openings 20*a*, 20*b*, 20*c*. The openings 20*a*, 20*b* are arranged on the side 38*a* of the intermediate wall 36, whereas the opening 20*c* is arranged on the side 38*b*. The sloping part 49*a* of the bottom section 50 being arranged between the guide walls 46*a*, 46*b* (indicated by dashed lines) is flanked by opening 20*a*. The sloping part 49*b* of the bottom section 50 is flanked by opening 20*b*. The opening 20*c* is flanked by the lateral end sections 52*a*, 52*b* of the guide walls 46*a*, 46*b*. The openings 20*a*, 20*b*, 20*c* represent three flow paths for the components to be mixed, wherein the inner surface of the mixer housing 12 partially forms part of these flow paths by forming an outer guide wall.

The cross-section according to FIG. 2 could have been also made along section line B-B, whereby the holes 20*a*, 20*b* then would have been separated from hole 20*c* by the transverse guide wall 45.

FIG. 3*a* shows a perspective part view of the static mixer 10. FIG. 3*b* shows the same mixer 10 rotated by 180° about the longitudinal axis $A_L$. Both views in particular illustrate the arrangement of the flow obstructions 40*a*, 40*b* as well as the arrangement of the separating wall 32. The mixer housing 12 has been omitted to provide a better overview.

The separating wall 32 comprises two thickened segments 35 arranged at a periphery of the output surface 30. Both thickened segments 35 are followed by curved segments 34*a* which both extend to an edge of the outlet 28*a*. From here two linear segments 34*b* follow which both extend to an edge of the outlet 28*b*. The linear segments 34*b* are interconnected by a curved segment 34*c* which partly surrounds the outlet 28*b*. The outlets 28*a*, 28*b* hence are separated by the separating wall 32. The separating wall 32 in cooperation with the output surface 30, with the shoulder 13 (see FIGS. 1*a*, 1*b*) being in direct contact with an upper side of the thickened segments 35 and with the wider section 11 of the mixer housing 12 defines distinct volumes accessible for both components after leaving the outlets 28*a*, 28*b*. The volume assigned to the outlet 28*a* is essentially the same as the volume assigned to the outlet 28*b*. The volume assigned to the outlets 28*a*, 28*b* can be adjusted by varying the size and position of the thickened segments 35.

The flow obstruction 40*a* has a plane lenticular shape and partly overlaps with the outlet 28*a* (see also FIG. 4*a*). The flow obstruction 40*a* further comprises an outer rim 41 supporting the shoulder 13 of the mixer housing 12 (see FIGS. 1*a*, 1*b*). It becomes clear that the narrow housing section 15 surrounds the mixing element 14 and the intermediate wall 36. The flow obstruction 40*b* likewise has a plane lenticular shape and partly overlaps with the outlet 28*b* (see also FIG. 4*a*). Also the flow obstruction 40*b* comprises a rim 41 for supporting the shoulder 13 of the mixer housing 12. The flow obstructions 40*a*, 40*b* ensure that the components leaving the outlets 28*a*, 28*b* foremost occupy the volume defined by the separating wall 32 in cooperation with the shoulder 13 of the mixer housing 12 and its wider section 11 before they proceed beyond the downstream edge 33.

FIGS. 4*a*, 4*b*, 4*c* respectively show a cross-sectional perspective part view (along section line C-C of FIG. 1*b*) of the static mixer 10. The mixer housing 12 has been omitted to provide a better overview. The meandering pattern of the separating wall 32 comprising the two thickened segments 35, three curved segments 34*a*, 34*c* and two linear segments 34*b* being aligned parallel to each other becomes clearly visible. Moreover, it is shown that the intermediate wall 36 traverses the two linear segments 34*b* of the separating wall 32 at an angle of approximately 90°. In FIGS. 4*a* and 4*b* the course of the separating wall 32 beneath the flow obstructions 40*a*, 40*b* and the intermediate wall 36 is indicated by a dashed line. Further, it becomes clear that approximately two fifth of the openings 28*a*, 28*b* overlap with a cross-sectional area of the tube-like narrow housing section 15 (see FIGS. 1*a*, 1*b*) The cross-sectional area of the narrow housing section 15 is defined by the rims 41 which lie on the circumference of an imaginary circle. In other embodiments the overlap of the openings 28*a*, 28*b* with the narrow housing section 15 can be set within a range of between one fifth and one half.

FIGS. 5*a*, 5*b*, 5*c* respectively show a cross-sectional perspective part view of a static mixer according to the invention. The static mixers 10 depicted in FIGS. 5*a*, 5*b*, 5*c* differ from each other in the design of the separating wall 32. The shape of the different separating walls 32 becomes clearly obvious. In FIG. 5*a* the separating wall 32 comprises two thickened segments 35 respectively followed by a curved segment 34*a* and a linear segment 34*b*. The two linear segments 34*b* being arranged inclined to each other are interconnected by another curved segment 34*c*. Instead of the two linear segments 34*b*, the separating wall 32 according to FIG. 5*b* comprises two curved segments 34*a* being interconnected with another curved segment 34*c*. The separating wall 32 according to FIG. 5*c* does not comprise thickened segments 35. The thickened segments 35 are respectively replaced by two linear segments 34*b* which together with the mixer housing 12 and the output surface 30 of the mixing head 22 enclose a volume 31 being not accessible for the components leaving the outlets 28*a*, 28*b*.

FIG. 6 is identical to the cross-sectional view of FIG. 4*b* and indicates in addition the flow paths of the components. To provide a better overview most of the reference numerals have been omitted. In operation of the static mixer 10 a first component A is fed from a cartridge into the inlet 24*a* and a second component B is fed from the cartridge into the inlet 24*b*. Both components A, B proceed through the mixing head 22 until reaching the outlets 28*a*, 28*b* on the output surface 30. Each component A, B leaves the respective outlet 28*a*, 28*b* and starts to occupy the volume defined by the separating wall 32, the output surface 30 and the mixer housing 12. Thereby the flow obstructions 40*a*, 40*b* prevent the components A, B from premature proceeding beyond the downstream edge 33 of the separating wall 32 and from directly entering the entry openings 20*a*, 20*b*, 20*c*. The flow obstructions 40*a*, 40*b* are dimensioned such that the entry openings 20*a*, 20*b*, 20*c* are simultaneously and uniformly supplied by the components. An undue forerunning of either of the components is prevented.

Due to the meandering pattern of the separating wall 32 the components A, B when reaching the downstream edge 33 are arranged side by side in three partial flows or streaks in a plane perpendicular to the longitudinal axis $A_L$. These three partial flows are indicated by arrows A1, B1, B2, wherein A1 corresponds to component A and B1, B2 correspond to component B. The partial flow A1 of component A is flanked by two partial flows B1, B2 of component B. After exceeding the downstream edge 33 of the separating wall 32 the three partial flows A1, B1, B2 combine (without becoming intermixed) and are transversely divided by the intermediate wall 36 such that six partial flows $A1_1$, $A1_2$, $B1_1$, $B1_2$, $B2_1$, $B2_2$ result which are indicated by six arrows pointing upwards out of the drawing's plane. $A1_1$, $A1_2$ represent the divided partial flow A1 of component A. $B1_1$, $B1_2$, $B2_1$, $B2_2$ represent the respectively divided partial flows B1 and B2 of component B. Three partial flows, i.e. $A1_1$, flanked by $B1_2$ and $B2_2$, are located on side 38*a* and three partial flows, i.e. $A1_2$ flanked by $B1_1$ and $B2_1$, are located on side 38*b* of the intermediate wall 36.

As regards side 38*a* of the intermediate wall 36, when proceeding further the partial flow $A1_1$ encounters the bottom edge 51 of the bottom section 50 of the first mixer element 42 (see FIG. 2). The bottom edge 51 splits $A1_1$ into two parts which are respectively forced sideways to jointly enter the openings 20*a*, 20*b* together with one of the two outer partial flows $B1_2$ and $B2_2$, respectively. Thus, the entry opening 20*a* is fed with a partial flow consisting of $A1_1$ and $B1_2$ and the entry opening 20*b* is fed with a partial flow consisting of $A1_1$ and $B2_2$. This distribution is indicated by FIG. 7 showing a simplified cross-sectional view along the entry plane of entry openings 20*a*, 20*b*, 20*c*.

As regards the other side 38*b* of the intermediate wall 36, when proceeding further each of the two outer partial flows $B1_1$ and $B2_1$ encounter one of the lateral sections 52*a*, 52*b* (see FIG. 2). Thereby the partial flows $B1_1$, $B2_1$ are forced sideways towards partial flow $A1_2$ which encounters the opening 20*c*. Thus, the opening 20*c* is fed with a partial flow consisting of $A1_2$ flanked by $B1_1$ and $B2_1$ as indicated by FIG. 7.

Thus, each opening 20*a*, 20*b*, 20*c* of the first mixer element 42 is fed with partial flows of both components A, B. Altogether, this results in seven alternating partial flows being fed into the entry openings 20*a*, 20*b*, 20*c*. The partial flows are split as follows among the openings 20*a*, 20*b*, 20*c* starting from opening 20*a*: $B1_2$, $A1_1$, $B1_1$, $A1_2$, $B2_1$, $A1_1$, $B2_2$. This leads to a high mixing level already emerging after the first mixer element 42 has been passed. Thereby the total number of successive mixer elements 42 can be kept small and the total length of the static mixer can thus be reduced.

LIST OF REFERENCE NUMERALS

10 static mixer
11 wider housing section
12 mixer housing
13 shoulder
14 mixing element
15 narrow housing section
16 upstream end
18 downstream end
20*a*, 20*b*, 20*c* entry opening
22 mixing head
24*a*, 24*b* inlets
26 input side
28*a*, 28*b* outlets
30 output surface
31 volume
32 separating wall
33 downstream edge
34*a*, 34*c* curved segment
34*b* linear segment
35 thickened segment
36 intermediate wall
38*a*, 38*b* sides defined by intermediate wall
40*a*, 40*b* flow obstruction
41 rim
42 mixer element
44 transverse edge
45 transverse guide wall
46*a*, 46*b* guide walls
48 separating edge
49*a*, 49*b* sloping part

50 bottom section
51 bottom edge
52*a*, 52*b* lateral end section
54*a*, 54*b* sides of transverse edge
56 strut
$A_L$ longitudinal axis
A1, A1$_1$, A1$_2$ partial flows of component A
B1, B2, B1$_1$, B1$_2$, B2$_1$, B2$_2$ partial flows of component B

The invention claimed is:

1. A static mixer for mixing together at least two components, comprising:

a mixer housing;

a mixing element having an upstream end with at least two entry openings and a downstream end, the mixing element being arranged at least partly within the mixer housing;

a mixing head having at least two inlets provided at an input side and at least two outlets provided at an output surface, each of the at least two inlets in fluid communication with one of the at least two outlets;

a separating wall disposed between the output surface and the up-stream end of the mixing element for separating the components leaving the outlets, the separating wall comprising a free downstream edge disposed with respect to at least one of the entry openings so as to enable at least partial flows of the components separated by the separating wall to combine after exceeding the downstream edge and to jointly enter the at least one of the entry openings; and at least one flow obstruction disposed between the upstream end of the mixing element and the output surface for deflecting the components or at least partial flows of the components; and an intermediate wall traversing at least two segments of the separating wall such that the intermediate wall divides each of three partial flows that exceed the downstream edge of the separating wall on one side of the two segments, between the two segments, and on the other side of the two segments, respectively, into two.

2. The static mixer according to claim 1, wherein the separating wall has a meandering pattern.

3. The static mixer according to claim 1, wherein the separating wall comprises at least two segments that are in parallel to each other.

4. The static mixer according to claim 1, wherein the separating wall comprises the following segments in the stated order:

a curved segment, a linear segment, a linear or curved segment, a linear segment and a curved segment.

5. The static mixer according to claim 1, wherein the separating wall comprises thickened segments for reducing a volume accessible for the components when leaving the outlets.

6. The static mixer according to claim 1, wherein the separating wall at least partially frames at least one of the at least two outlets or at least one of the at least two entry openings.

7. The static mixer according to claim 1, wherein the separating wall is integrally formed with the mixing element or with the mixing head.

8. The static mixer according to claim 1, wherein the separating wall, the mixing head, and the mixing element are a one-piece construction.

9. The static mixer according to claim 8, wherein the one-piece construction is formed by injection molding.

10. The static mixer according to claim 1, wherein the intermediate wall is disposed between the upstream end of the mixing element and the separating wall.

11. The static mixer according to claim 1, wherein the intermediate wall traverses at least one linear segment of the separating wall at an angle of between 70° and 110°.

12. The static mixer according to claim 1, wherein the intermediate wall traverses at least one linear segment of the separating wall at an angle of between 80° and 100°.

13. The static mixer according to claim 1, wherein the intermediate wall traverses at least one linear segment of the separating wall at an angle of between 85° and 95°.

14. The static mixer according to claim 1, wherein the intermediate wall traverses at least one linear segment of the separation wall at an angle of approximately 90°.

15. The static mixer according to claim 1, wherein the at least one flow obstruction is disposed between the downstream edge of the separating wall and the upstream end of the mixing element or is essentially disposed in one plane with the downstream edge of the separating wall.

16. The static mixer according to claim 1, wherein the mixing element comprises a plurality of mixer elements arranged one after another for a repeated separation and re-combination of streams of the components to be mixed.

17. The static mixer according to claim 16, wherein the mixing element comprises mixer elements for separating the material to be mixed into a plurality of streams, and elements configured for the layered merging of the same, including a transverse edge and guide walls that extend at an angle to the transverse edge, as well as guide elements arranged at an angle to a longitudinal axis and provided with openings, the mixing element comprising a transverse edge and a following transverse guide wall and at least two guide walls ending in a separating edge each with lateral end sections and with at least one bottom section disposed between the guide walls, thereby defining at least one opening on one side of the transverse edge and at least two openings on the other side of the transverse edge.

18. The static mixer according to claim 16, wherein the mixing element comprises mixer elements for separating the material to be mixed into a plurality of streams, and elements configured for layered merging of the same, including separating edges and a transverse edge that extends at an angle to the separating edges, as well as deflecting elements arranged at an angle to the longitudinal axis and provided with openings, the mixing element comprising at least two separating edges with following guide walls with lateral end sections and with at least one bottom section disposed between the guide walls, and a transverse edge arranged at one end of a transverse guide wall, thereby defining at least one opening on one side of the transverse edge and at least two openings on the other side of the transverse edge.

19. A dispensing apparatus comprising a multi-component cartridge and the static mixer according to claim 1 connected to the multi-component cartridge.

20. The dispensing apparatus according to claim 19, wherein the multi-component cartridge is filled with respective components.

21. A method comprising:

employing a static mixer to dispense components from a multi-component cartridge, the static mixer including a mixer housing, a mixing element having an upstream end with at least two entry openings and a downstream end, the mixing element being arranged at least partly within the mixer housing, a mixing head having at least two inlets provided at an input side and at least two outlets provided at an output surface, each of the at least two inlets in fluid communication with one of the at least two outlets, a separating wall disposed between the output surface and the up-stream end of the mixing element, the separating wall separating the components leaving the outlets, and comprising a free downstream edge disposed with respect to at least one of the entry openings so as to enable at least partial flows of the components separated by the separating wall to combine after exceeding the downstream edge and to jointly enter the at least one of the entry openings, and at least one flow obstruction disposed between the upstream end of the mixing element and the output surface for deflecting the components or at least partial flows of the components, and an intermediate wall traversing at least two segments of the separating wall such that the intermediate wall divides each of three partial flows that exceed the downstream edge of the separating wall on one side of the two segments, between the two segments, and on the other side of the two segments, respectively, into two.

22. A method comprising:

providing a dispensing apparatus comprising a multi-component cartridge and a static mixer connected to the multi-component cartridge, the static mixer including a mixer housing, a mixing element having an upstream end with at least two entry openings and a downstream end, the mixing element being arranged at least partly within the mixer housing, a mixing head having at least two inlets provided at an input side and at least two outlets provided at an output surface, each of the at least two inlets in fluid communication with one of the at least two outlets, a separating wall disposed between the output surface and the up-stream end of the mixing element, the separating wall separating the components leaving the outlets, and comprising a free downstream edge disposed with respect to at least one of the entry openings so as to enable at least partial flows of the components separated by the separating wall to combine after exceeding the downstream edge and to jointly enter the at least one of the entry openings, at least one flow obstruction disposed between the upstream end of the mixing element and the output surface for deflecting the components or at least partial flows of the components, and an intermediate wall traversing at least two segments of the separating wall such that the intermediate wall divides each of three partial flows that exceed the downstream edge of the separating wall on one side of the two segments, between the two segments, and on the other side of the two segments, respectively, into two; and operating the dispensing apparatus to dispense components from the multi-component cartridge via the static mixer.

23. A static mixer for mixing together at least two components comprising:

a mixer housing;

a mixing element having an upstream end with at least two entry openings and a downstream end, the mixing element being arranged at least partly within the mixer housing;

a mixing head having at least two inlets provided at an input side and at least two outlets provided at an output surface, wherein each of the at least two inlets is in fluid communication with one of the at least two outlets; and a separating wall disposed between the output surface and the upstream end of the mixing element for separating the components leaving the outlets, the separating wall comprising a free downstream edge which is disposed with respect to at least one of the entry openings so as to allow at least partial flows of the components separated by the separating wall to combine after exceeding the downstream edge and to jointly enter said at least one of the entry openings, and the separating wall surrounding at least one of the at least two outlets or at least one of the at least two entry openings along at least a quarter of a perimeter of the at least one of the at least two outlets or the at least one of the at least two entry openings.

* * * * *